United States Patent [19]

Pryor

[11] Patent Number: 5,072,684

[45] Date of Patent: Dec. 17, 1991

[54] MEANS FOR PREVENTING LEAKS FROM A LIQUID-BULK CARRIER CARGO SHIP

[76] Inventor: Frank R. Pryor, Box 243, Minersville, Utah 84752

[21] Appl. No.: 662,174

[22] Filed: Feb. 28, 1991

[51] Int. Cl.[5] ..... B63B 43/16

[52] U.S. Cl. ..... 114/229

[58] Field of Search ..... 114/227, 228, 229; 220/232; 405/12, 60, 65

[56] References Cited

U.S. PATENT DOCUMENTS

| | | | |
|---|---|---|---|
| 635,939 | 10/1899 | Mason | 114/229 |
| 770,078 | 9/1904 | Kruger | 114/229 |
| 4,325,653 | 4/1982 | Teasdale | 114/267 |
| 4,626,132 | 12/1986 | Allen | 405/71 |
| 4,640,645 | 2/1987 | Simpson | 405/63 |
| 4,795,567 | 1/1989 | Simpson | 210/744 |
| 4,800,025 | 1/1989 | Bibaeff | 210/703 |
| 4,935,152 | 6/1990 | Gonzales | 210/747 |

FOREIGN PATENT DOCUMENTS

| | | |
|---|---|---|
| 52-13164 | 2/1977 | Japan . |
| 927912 | 6/1963 | United Kingdom . |
| 1371993 | 10/1974 | United Kingdom . |
| 1411388 | 10/1975 | United Kingdom . |

*Primary Examiner*—Jesus D. Sotelo

*Attorney, Agent, or Firm*—Terry M. Gernstein

[57] ABSTRACT

A rupture in a portion of the cargo hold area of a liquid-bulk carrier cargo ship is closed by attaching a one-piece, flexible, liquid-impermeable blanket to the hull adjacent to the rupture, then placing a plurality of further holding elements over that blanket and attaching those holding elements to the ship. The preferred form of the blanket includes neoprene sheeting material. Alternative forms of the holding elements include telescoping sections in a sleeve.

5 Claims, 3 Drawing Sheets

MEANS FOR PREVENTING LEAKS FROM A LIQUID-BULK CARRIER CARGO SHIP

TECHNICAL FIELD OF THE INVENTION

The invention relates to the general art of cargo shipping, and to the particular field of preventing environmental damage due to leaks in liquid cargo ships.

BACKGROUND OF THE INVENTION

Spillage of liquid from liquid-bulk carrier cargo ships has been a problem since the first liquid-bulk carrier cargo ship was launched. However, in recent times, such problem has become extremely noticeable and has created several environmental disasters. This is particularly true when the liquid cargo is oil or other such product that has the potential to inflict great harm on the environment.

Typically, a liquid-bulk carrier cargo ship includes at least one large liquid containing hold that is partly formed by at least a portion of the ship's hull. These ships generally have an onboard pumping system for loading the liquid cargo into the hold and for offloading the cargo from the hold at the ship's destination. The pumping system thus includes a fluid connection into the cargo hold and a conduit that can be fluidically connected to a facility that is spaced from the ship, such as an onshore storage facility or the like.

One common cause of the aforementioned cargo spillage is the rupturing of the ship's hull. This rupturing can result from numerous causes, such as collision, weakening of the hull structure, or the like. Whatever the cause, the rupture may result in great quantities of the liquid cargo spilling out of the ship and into any body of water in which the ship is located at the time.

Due to the problem with spills, the art has included several designs intended to contain the spilled product. Such designs have included portable booms that are deployed around the spill, inflatable mechanism, and the like. While somewhat successful in many situations, most of these device have several drawbacks. One such drawback results because the device must be brought to the spill site from somewhere else. In the time that the device is being transported to the spill site, great damage can be done. In fact, many of the most damaging spills have occurred because the leaking ship was permitted to leak for several days until proper containment mechanisms were moved into the vicinity of the ship.

Another drawback is directly related to the very nature and principles of the devices. These devices are intended to contain a spilled product in a particular area after the liquid has already spilled from the ship. Weather or other conditions may inhibit the effectiveness of such devices. Furthermore, even if the devices are effective, the cargo is still in the water and may create great problems, even if it is contained to a specific area and location.

Still further, since these devices are intended to be deployed in the water surrounding the ship, they may be subjected to difficult and harsh weather conditions. Such conditions may make deployment of the containment device difficult or ineffective.

Therefore, there is a need for a device for preventing a rupture in a ship from allowing any liquid cargo from causing great damage to the water in which a liquid-bulk carrier is located, yet which is efficient to store and deploy, and which will not be unduly sensitive to weather or sea conditions. More specifically, there is a need for a device for preventing a rupture in a liquid-bulk ship hull from allowing liquid cargo to leak out of the ship in the first place and which can be stored on the ship and deployed within an area that is not subjected to weather conditions.

OBJECTS OF THE INVENTION

It is a main object of the present invention is to provide a device for preventing a rupture in a ship from allowing liquid carried in a liquid-bulk carrier from causing damage to the water in which the ship is located.

It is another object of the present invention to provide a device for preventing liquid in a liquid-bulk carrier ship from leaking out of the hold of such ship due to a rupture in the hull of such ship.

It is another object of the present invention to provide a device for preventing liquid in a liquid-bulk carrier ship from leaking out of the hold of such ship due to a rupture in the hull of such ship using a device which can be stored onboard the ship at all times.

It is another object of the present invention to provide a device for preventing liquid in a liquid-bulk carrier ship from leaking out of the hold of such ship due to a rupture in the hull of such ship using a device which can be stored onboard the ship at all times and which can be deployed from the ship itself.

SUMMARY OF THE INVENTION

These, and other, objects are achieved by a device which is carried onboard a liquid-bulk cargo ship which has a cargo hold defined, at least in part, by a portion of the ship's hull. The device is deployed from and closely adjacent to the ship, and thus will not be subject to weather conditions, and can prevent the liquid cargo from entering the water in which the ship is located. Therefore, the containment process can be extremely effective, rapid and not subject to the vagaries of weather conditions. Since the liquid is actually prevented from entering the water, the problems associated with such liquid in the water are avoided.

The device includes a flexible, liquid-impermeable, one-piece sealing blanket that is magnetically attached to the side of the hull adjacent to, and in covering relation with, the breach in the hull. The device includes an electromagnet in the blanket that is used to initially secure the blanket to the hull, and a plurality of further electromagnetic devices that are placed over the blanket and in contact with the hull to hold the blanket in place over the breach. The electromagnets are all connected to a source of power by a control means, and can be interconnected using jack connectors whereby any number of electromagnets can be used. The control means controls the amount of power applied to the magnets to ensure that the breach is closed.

BRIEF DESCRIPTION OF THE DRAWING FIGURES

DETAILED DESCRIPTION OF THE PREFERRED EMBODIMENT OF THE INVENTION

Figure 1:
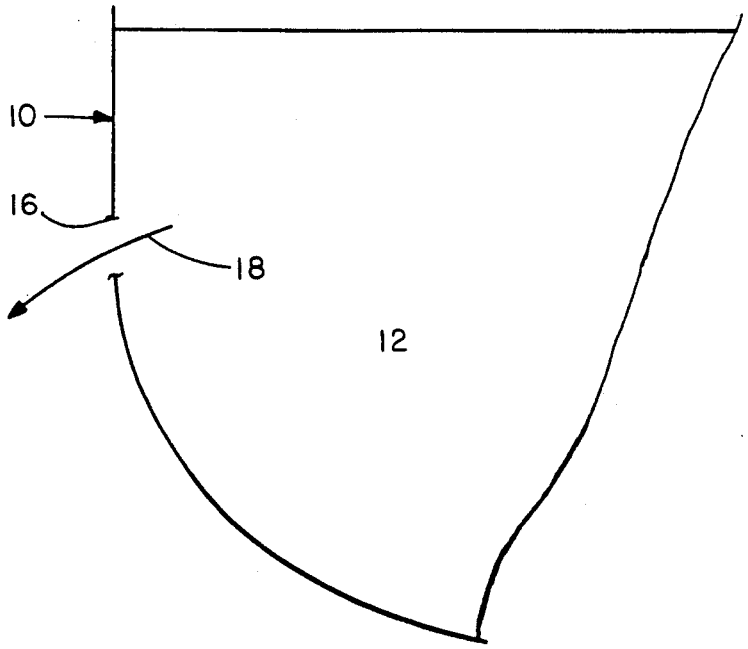
FIG. 1 illustrates a portion of a liquid-bulk carrier cargo ship, with a rupture in a portion of the ship's hull adjacent to the cargo hold in which liquid is being stored.

Shown in FIG. 1 is a portion of a hull 10 of a liquid-bulk carrier cargo ship. The ship carries liquid 12, such as oil, or the like in a hold adjacent to the hull. The hull 10 of the ship is subject to being breached as at rupture 16 whereby fluid may be freed to flow out of the ship and into the water in which the ship is located, as indicated in FIG. 1 by arrow 8. As discussed above, such leakage may be extremely undesirable.

Figure 2:
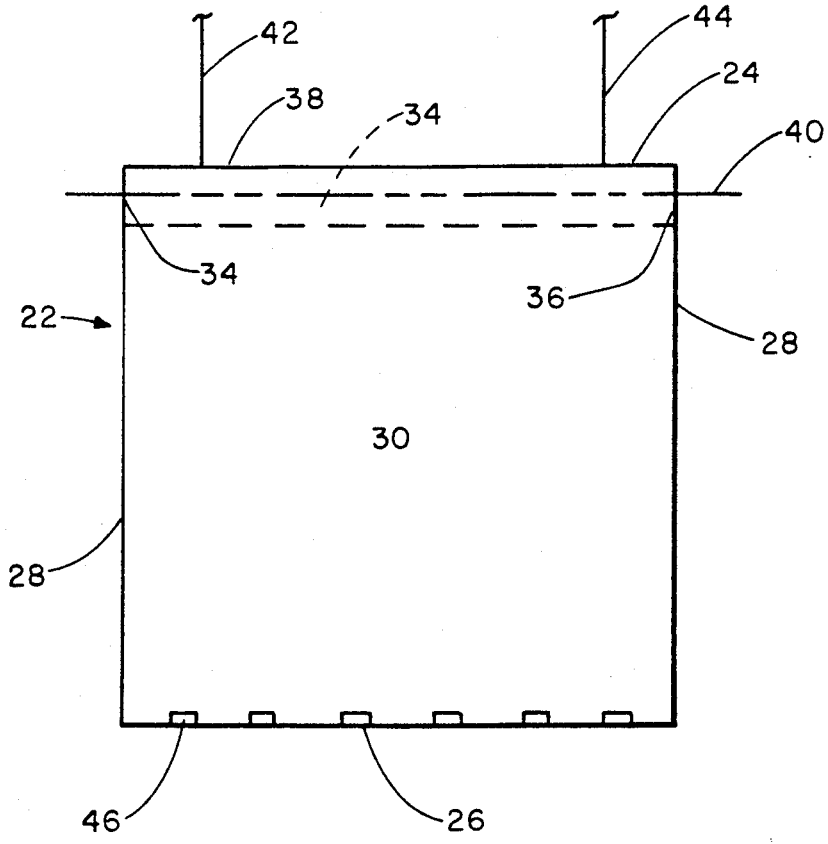
FIG. 2 illustrates the rupture sealing blanket of the present invention in an initially-deployed configuration.
Figure 4:
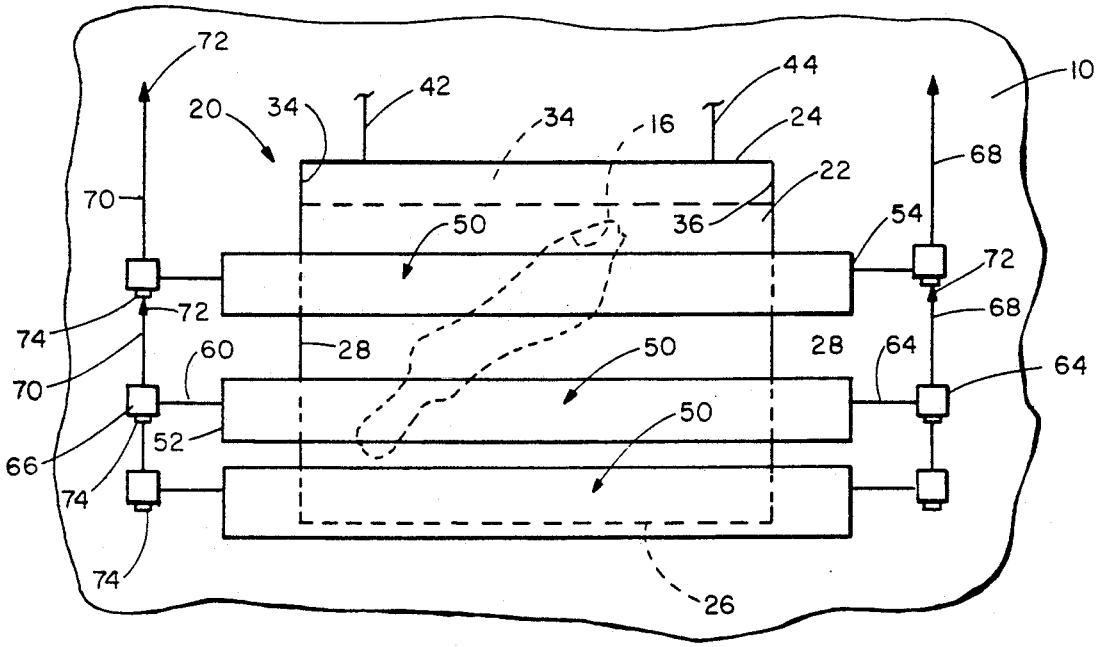
FIG. 4 illustrates the rupture sealing blanket of the present invention in a fully deployed configuration.

The device 20 embodying the present invention is shown in FIGS. 2 and 4, in the partially deployed configuration and in the fully deployed configuration, respectively. The device 20 is intended to cover the rupture 16 in an efficient and effective manner.

The device includes a fluid-impermeable blanket 22 that is formed as one piece and is monolithic to ensure its integrity. The blanket is also impermeable to the fluid stored in the ship as well as to the water in which the ship is located so that neither fluid will be contaminated by the other flowing through the blanket once that blanket is in place covering the breach 16. The blanket 22 includes a top edge 24, a bottom edge 26, and side edges 28 defining the periphery thereof. The blanket also includes a top surface 30 (seen in FIG. 2) and a bottom surface that will abut the outside surface of the ship when the blanket is in place. The blanket has a length dimension extending between the top edge 24 and the bottom edge 26 and a width dimension extending between the two sides 28. The blanket is preferably formed of neoprene sheeting and can be reinforced with steel rods running widthwise or lengthwise as suitable.

An electromagnet 34 is embedded in the blanket adjacent to the top edge 24 thereof. The electromagnet 34 can be embedded in a hem defined in the blanket or within plys of the blanket as suitable, and has two ends 36 and 35 that are located to be collinear with the blanket side edges 28, a top edge 38 that is in abutting and adjacent relationship with the inside of the blanket top edge 24. The electromagnet has a longitudinal centerline 40 extending between the two ends 35 and 36 and a length dimension measured along the longitudinal centerline between the two ends 35 and 36 that is equal to the width dimension of the blanket. The electromagnet includes two electrical leads 42 and 44 that connect that electromagnet to a source of electrical power. Once energized, the electromagnet will magnetically adhere to the ship's hull thereby attaching the blanket 22 to that hull. The top location of the electromagnet 34 with respect to the blanket causes that blanket to depend from the electromagnet. Thus, the electromagnet 34 is placed superadjacent to the rupture 16 so the blanket hangs down over that rupture. Weights, such as weight 46 are affixed to the blanket bottom end 26 to assist in the proper deployment of the blanket. The weights 46 can also be permanent magnets if suitable.

Figure 3:
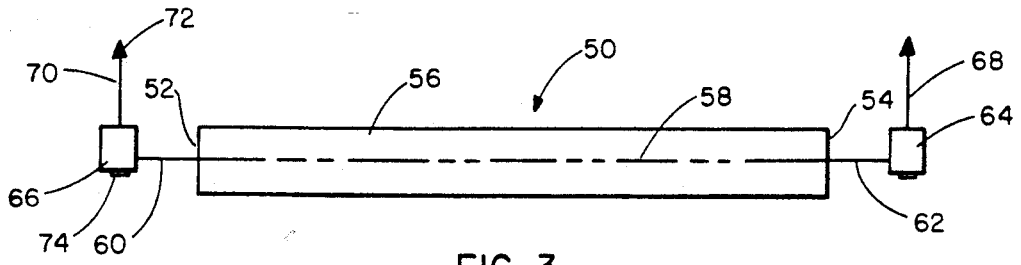
FIG. 3 illustrates one of a plurality of electromagnets used to fully attach the flexible blanket to the hull adjacent to a rupture in that hull.
Figure 5:
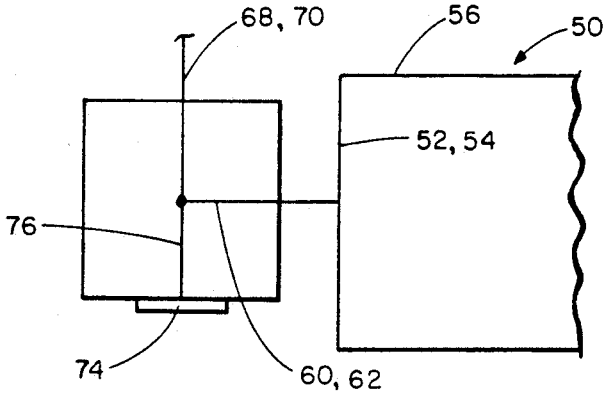
FIG. 5 illustrates a connection element used to couple one electromagnetic device to other electromagnetic devices.

As shown in FIGS. 3 and 4, the device 20 further includes a plurality of electromagnetic holding elements 50 that are spaced apart from each other along the blanket length. Each holding element 50 includes two ends 52 and 54, a sidewall 56 connecting the ends together, and a longitudinal centerline 58 extending between the two ends 52 and 54. Each holding element 50 has a length dimension measured along the longitudinal centerline 58 between the two ends 52 and 54, with the holding element lengths being greater than the length of the electromagnet 34. Each holding element, like the electromagnet 34, includes an electrically powered magnet that receives power via line conductors 60 and 62. Each line conductor is connected to an electrical connector element, such as connector elements 64 and 66 shown in FIGS. 3 and 5. The elements 50 further include line conductors 68 and 70 electrically connected to the connector elements 64 and 66 respectively. Each line conductor 68 and 70 includes a male jack element 72 on an end thereof remote from the connector element. Each connector element further includes a female jack element 74 electrically connected to the line conductor 68 or 70 by a line conductor 76. Therefore, any line conductor 68 or 70 connected to a female jack element 74 will also be electrically connected in parallel with the next holding element so the holding elements can be strung together in parallel as indicated in FIG. 4. The holding elements are preferably rectangular in cross-sectional shape, but could be cylindrical or the like if suitable.

Figure 6:
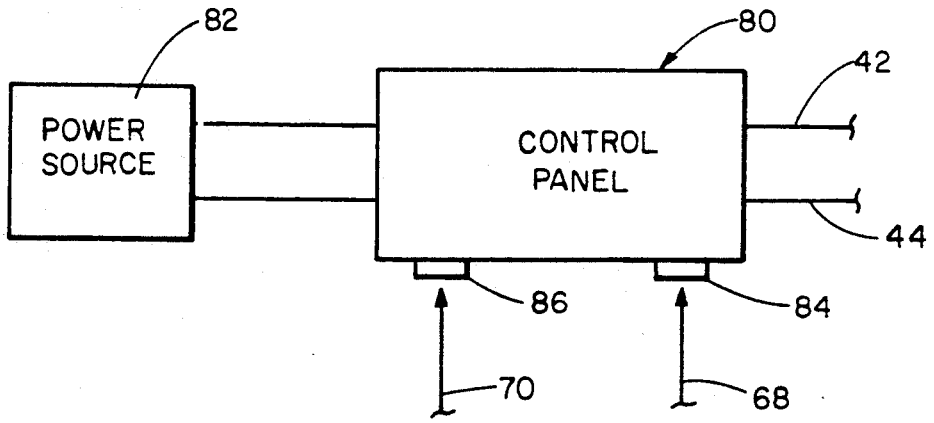
FIG. 6 illustrates a control mechanism for connecting the electromagnetic devices to a power source.

As indicated in FIG. 6, a control panel 80 electrically connects a power source 82 to the line conductors 42 and 44 and to the line conductors 68 and 70. The power source can include a storage battery, ship's power, or the like, and the control panel can include bridge circuits, and the like whereby the amount of power applied to the electromagnet 34 can be varied and can be different from the amount of power applied to the holding elements, which can also be varied whereby the overall holding and attaching forces mounting the blanket to the ship's hull can be varied as required. The control panel further includes female jack elements 84 and 86 that are electrically connected to the line conductors 68 and 70 respectively to apply power to the holding elements.

As shown in FIG. 4, several holding elements are placed on the blanket at various locations thereon. In order to position these holding elements at the most desirable spacings, the device further includes one or more extension elements 90, best shown in FIG. 7. Each extension element includes a line conductor 92 having a female jack element 94 on one end thereof and a male jack element 96 on the other end thereof. The female jack element 94 receives a male jack element 72, and the male jack element 96 is received in a female jack element 74 or to the female jack elements 84 and 86. The extension elements permit the spacing between the holding elements and between the holding elements and the electromagnet 34 to be varied as required to securely close the hull rupture.

Figure 7:
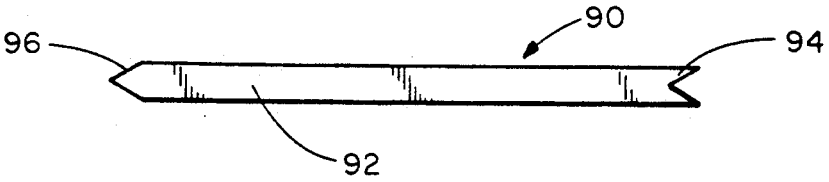
FIG. 7 illustrates an extension element for customizing the rupture sealing device of the present invention whereby large and small ruptures can be covered.
Figure 8:
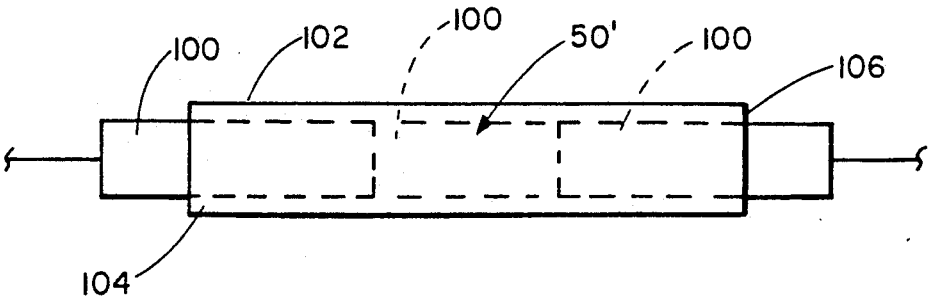
FIG. 8 is an alternative form of electromagnetic device that can be extended to further customize the rupture sealing device of the present invention.

An alternative holding element 50′ is shown in FIG. 7. This holding element 50′ includes a plurality of telescoping sections 100 surrounded by a sleeve 102 of rubber or like material. The sleeve 102 includes ends 104 and 106 and a length dimension measured between these two ends 104 and 106 that is equal to the length dimension of the holding elements 50 when the element 50' is fully extended. The sleeve length is approximately equal to the length of the electromagnet 34 and hence equal to the width of the blanket as measured between the blanket sides 28. The sleeve 102 is collapsible so the length of the holding element can be varied as the sections 100 are telescoped into each other.

The blanket is applied by first activating the power source, then attaching the blanket to the outside of the hull over the breach 16 using the electromagnet 34, then deploying it over the breach. The holding elements are then applied over the blanket and attached to the hull.

It is understood that while certain forms of the present invention have been illustrated and described herein, it is not to be limited to the specific forms or arrangements of parts described and shown.

I claim:

1. In a liquid-bulk carrier cargo ship having a hold defined in part by a hull portion and a deck portion of the ship, the improvement in combination therewith comprising:

(A) an electromagnet having ends, a sidewall connecting said ends together, a longitudinal centerline extending between said ends and a length dimension measured along said longitudinal centerline between said two ends;

(B) two electrical leads connected to said electromagnet;

(C) a control panel connected to said electrical leads, said control panel being electrically connected to said electromagnet electrical leads and having two female jack elements;

(D) a power source electrically connected to said control panel to be electrically connected to said electromagnet electrical leads and to said control panel female jack elements via said control panel;

(E) a flexible, fluid-impermeable one-piece blanket, said blanket having a top edge, a bottom edge, two side edges connecting said blanket top edge to said blanket bottom edge, a width dimension measured between said blanket side edges and a length dimension measured between said blanket top edge and said blanket bottom edge, said electromagnet being embedded in said blanket adjacent to said blanket top edge, said electromagnet length dimension being equal to said blanket width dimension; and (F) a plurality of electromagnetic holding elements covering said blanket and attaching said blanket to a ship's hull, each electromagnetic holding element including (1) ends, a sidewall connecting said holding element ends together, a longitudinal centerline extending between said holding element ends, a length dimension measured between said electromagnetic holding element ends along said holding element longitudinal centerline, said holding element length dimension being greater than said electromagnet length dimension, (2) an electromagnet, (3) an electrical lead electrically connected to said holding element electromagnet at each of said holding element ends, (4) an electrical connecting element electrically connected to each holding element electrical lead at an end of said each lead that is remote from said holding element, said electrical connecting element including a female jack element electrically connected to said holding element electrical lead, and (5) a further electrical lead connected at one end thereof to said electrical connecting element, each further electrical lead including a male jack element on an end thereof remote from said electrical connecting element, said further electrical lead male jack elements being electrically connected to said control panel female jack elements.

2. The improvement defined in claim 1 wherein said plurality of holding elements are spaced apart from each other along said blanket length dimension.

3. The improvement defined in claim 2 further including an extension lead that includes an electrical conductor having a female jack element on one end thereof and a male jack element on another end thereof.

4. The improvement defined in claim 3 further including a rubber casing surrounding one of said holding elements.

5. The improvement defined in claim 4 wherein one of said holding elements includes a plurality of sections that are telescopically connected together.

* * * * *